US007708086B2

(12) United States Patent
Witte

(10) Patent No.: US 7,708,086 B2
(45) Date of Patent: May 4, 2010

(54) MODULAR DRILLING APPARATUS WITH POWER AND/OR DATA TRANSMISSION

(75) Inventor: Johannas Witte, Braunschweig (DE)

(73) Assignee: Baker Hughes Incorporated, Houston, TX (US)

( * ) Notice: Subject to any disclaimer, the term of this patent is extended or adjusted under 35 U.S.C. 154(b) by 390 days.

(21) Appl. No.: 11/282,995

(22) Filed: Nov. 18, 2005

(65) Prior Publication Data

US 2006/0124354 A1 Jun. 15, 2006

Related U.S. Application Data

(60) Provisional application No. 60/629,374, filed on Nov. 19, 2004.

(51) Int. Cl.
*E21B 4/02* (2006.01)

(52) U.S. Cl. ..... 175/40; 175/107

(58) Field of Classification Search ..... 175/40, 175/73, 76, 107

See application file for complete search history.

(56) References Cited

U.S. PATENT DOCUMENTS

| | | | | |
|---|---|---|---|---|
| 5,725,061 | A | 3/1998 | Van | |
| 5,957,221 | A | 9/1999 | Hay et al. | |
| 6,148,933 | A | 11/2000 | Hay et al. | |
| 6,247,542 | B1 | 6/2001 | Kruspe et al. | |
| 6,401,840 | B1 | 6/2002 | Hay et al. | |
| 6,427,783 | B2 | 8/2002 | Krueger et al. | |
| 6,446,736 | B1 | 9/2002 | Kruspe et al. | |
| 6,513,606 | B1 | 2/2003 | Krueger | |
| 6,540,032 | B1 * | 4/2003 | Krueger | 175/40 |
| 6,609,579 | B2 | 8/2003 | Krueger et al. | |
| 6,626,254 | B1 * | 9/2003 | Krueger et al. | 175/61 |
| 6,637,524 | B2 | 10/2003 | Kruspe et al. | |
| 6,913,095 | B2 | 7/2005 | Krueger | |
| 7,028,789 | B2 | 4/2006 | Krueger et al. | |
| 7,083,006 | B2 | 8/2006 | Kruspe et al. | |
| 7,168,510 | B2 * | 1/2007 | Boyle et al. | 175/107 |
| 7,306,060 | B2 | 12/2007 | Kriueger et al. | |
| 2003/0094310 | A1 | 5/2003 | Eppink et al. | |

FOREIGN PATENT DOCUMENTS

| | | |
|---|---|---|
| EP | 9624706 | 11/1994 |

* cited by examiner

*Primary Examiner*—William P Neuder
(74) *Attorney, Agent, or Firm*—Madan & Sriram, P.C.

(57) ABSTRACT

The present invention relates to devices and methods for conveying power and/or data signal along a wellbore bottom-hole assembly (BHA) having a steering unit, a bidirectional data communication and power ("BCPM") unit, a sensor sub, a formation evaluation sub, stabilizers. A power and/or data transmission line enables power transfer and two-way data exchange among these BHA components. In one embodiment, a drilling motor includes a transmission unit that transmits power and/or data between modules adjacent the motor via conductive elements in the rotor and/or the stator. A power/data transfer device is adapted to transfer power and/or data between the rotating and non-rotating sections of the transmission unit. The tooling and equipment making up the BHA can be formed as interchangeable modules. Each module can include electrical and data communication connectors at each of their respective ends so that power and data can be transferred between adjacent modules via modular threaded connections.

22 Claims, 7 Drawing Sheets

MODULAR DRILLING APPARATUS WITH POWER AND/OR DATA TRANSMISSION

CROSS-REFERENCE TO RELATED APPLICATIONS

This application takes priority from U.S. Provisional Application Ser. No. 60/629,374, filed Nov. 19, 2004.

BACKGROUND OF THE INVENTION

1. Field of the Invention

This invention relates generally to oilfield downhole tools and more particularly to modular drilling assemblies utilized for drilling wellbores in which electrical power and data are transferred between different modules and between rotating and non-rotating sections of the drilling assembly.

2. Description of the Related Art

To obtain hydrocarbons such as oil and gas, boreholes or wellbores are drilled by rotating a drill bit attached to the bottom of a drilling assembly (also referred to herein as a "Bottom Hole Assembly" or ("BHA"). The drilling assembly is attached to the bottom of a tubing or tubular string, which is usually either a jointed rigid pipe (or "drill pipe") or a relatively flexible spoolable tubing commonly referred to in the art as "coiled tubing." The string comprising the tubing and the drilling assembly is usually referred to as the "drill string." When jointed pipe is utilized as the tubing, the drill bit is rotated by rotating the jointed pipe from the surface and/or by a mud motor contained in the drilling assembly. In the case of a coiled tubing, the drill bit is rotated by the mud motor. During drilling, a drilling fluid (also referred to as the "mud") is supplied under pressure into the tubing. The drilling fluid passes through the drilling assembly and then discharges at the drill bit bottom. The drilling fluid provides lubrication to the drill bit and carries to the surface rock pieces disintegrated by the drill bit in drilling the wellbore via an annulus between the drill string and the wellbore wall. The mud motor is rotated by the drilling fluid passing through the drilling assembly. A drive shaft connected to the motor and the drill bit rotates the drill bit.

A substantial proportion of the current drilling activity involves drilling of deviated and horizontal wellbores to more fully exploit hydrocarbon reservoirs. Such boreholes can have relatively complex well profiles that may include contoured sections. To drill such complex boreholes, drilling assemblies are utilized that include steering assemblies and a suite of tools and devices that require power and signal/data exchange. Conventional power/data transmission systems for such drilling assemblies often restrict placement of certain tools due to difficulties in transferring power or data across individual drilling assembly components such as a drilling motor.

The present invention addresses the need for systems, devices and methods for efficiently transferring power and/or data between modules that make up a BHA.

SUMMARY OF THE INVENTION

In aspects, the present invention relates to devices and methods for conveying power such as electrical power and/or data signal along a wellbore bottomhole assembly (BHA). An exemplary BHA made in accordance with the present invention can be deployed with offshore or land-based drilling facilities via a conveyance device such as a tubular string, which may be jointed drill pipe or coiled tubing, into a wellbore. An exemplary BHA can include equipment and tools that utilize electrical power and can transmit/receive data. A power and/or data transmission line provided in the BHA enables power and/or data transfer among the individual tools or modules making up the BHA.

According to one embodiment of the present invention, a drilling motor adapted for use in such a BHA includes a transmission unit that transmits power and/or data between modules or tools positioned uphole and downhole of the motor (hereafter "power/data transmission unit"). An exemplary motor includes a rotor that rotates within a stator. The power/data transmission unit can include power/data carriers that transmit power and/or data across the motor via conductive elements in the rotor and/or the stator.

An exemplary power/data transmission unit includes a rotating conductive section in the rotor, a non-rotating conductive section in the stator or adjacent sub, and a power and/or data transfer device. In one embodiment, the rotating conductive section is made up of power and/or data carriers formed by a flexible member, a length compensation device, and a conductive element such as an insulated cable disposed inside the rotor. The non-rotating conductive section includes a non-rotating power/data line made up of a conductive element positioned along a portion of the stator or adjacent sub. The rotating conductive section rotates relative to the non-rotating conductive section. The power/data transfer device is adapted to transfer power and/or data between the rotating conductive section and the non-rotating conductive section. In one embodiment, the power/data transfer device includes a body, conductive elements coupled at one end to an external connector and at the other end to a contact assembly. The contact assembly maintains continuity of power and data transfer between conductive elements and the rotating power/data line. Additionally, the power/data transfer device can include a pressure compensation unit for controlling fluid pressure in the power/data transfer device. The flexible member and the length compensation unit accommodate the changes in radial motion and length of the rotor.

In another arrangement, the power/data transmission unit includes conductive elements that transfer power and/or data between the electrical contacts positioned at the ends of the drilling motor. In one embodiment, a threaded connection on a stator housing and a threaded connection on a shaft of the rotor can be provided with electrical contacts. Because the stator housing is stationary relative to the rotor, a power/data transfer device such as a slip ring cartridge or inductive coupling can be used to transfer power and/or data between the conductive elements in the stator and the conductive elements in the rotating shaft.

The power/data transmission unit and power/data transfer unit can be employed in multiple configurations, e.g., to transmit or transfer (i) only power, (ii) only data, or (iii) both data and power. Additionally, these units can include two or more carriers, each of which can be formed to carry only power, only data, or both power and data. The nomenclature "power/data" and "unit" are used merely for convenience to refer to all such configurations and not any particular configuration.

Exemplary BHA equipment that can also be connected to power and/or data transmission line includes a steering unit, a bidirectional data communication and power ("BCPM") unit, a sensor sub, a formation evaluation sub, and stabilizers. The BCPM sub provides power to the equipment such as the steering unit and two-way data communication between the BHA and surface devices. The sensor sub measures parameters of interest such as BHA orientation and location, rotary azimuthal gamma ray, pressure, temperature, vibration/dynamics, and resistivity. The formation evaluation sub can includes sensors for determining parameters of interest relating to the formation (e.g., resistivity, dielectric constant, water saturation, porosity, density and permeability), the borehole (e.g., borehole size, and borehole roughness), measuring geophysics (e.g., acoustic velocity and acoustic travel time), borehole fluids (e.g., viscosity, density, clarity, rheology, pH level, and gas, oil and water contents), and boundary conditions. The sensor and FE sub include one or more processors that provide central processor capability and data memory. Additional modules and sensors can be provided depending upon the specific drilling requirements. These sensors can be positioned in the subs and, distributed along the drill pipe, in the drill bit and along the BHA.

The equipment described above may be constructed as modules. For example, the BHA can include a BCPM module, a sensor module, a formation evaluation or FE module, a drilling motor module, a stabilizer module, and a steering unit module. Each of these modules can be interchangeable. Each module includes appropriate electrical and data communication connectors at each of their respective ends so that electrical power and data can be transferred between adjacent modules via modular threaded connections. Thus, the transmission line or conductive path formed by one or more conductive elements position in or along the above described modules and subs can be used to provide two-way (bi-directional) data transmission and transfer power along the BHA.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DETAILED DESCRIPTION OF THE INVENTION

Figure 1:
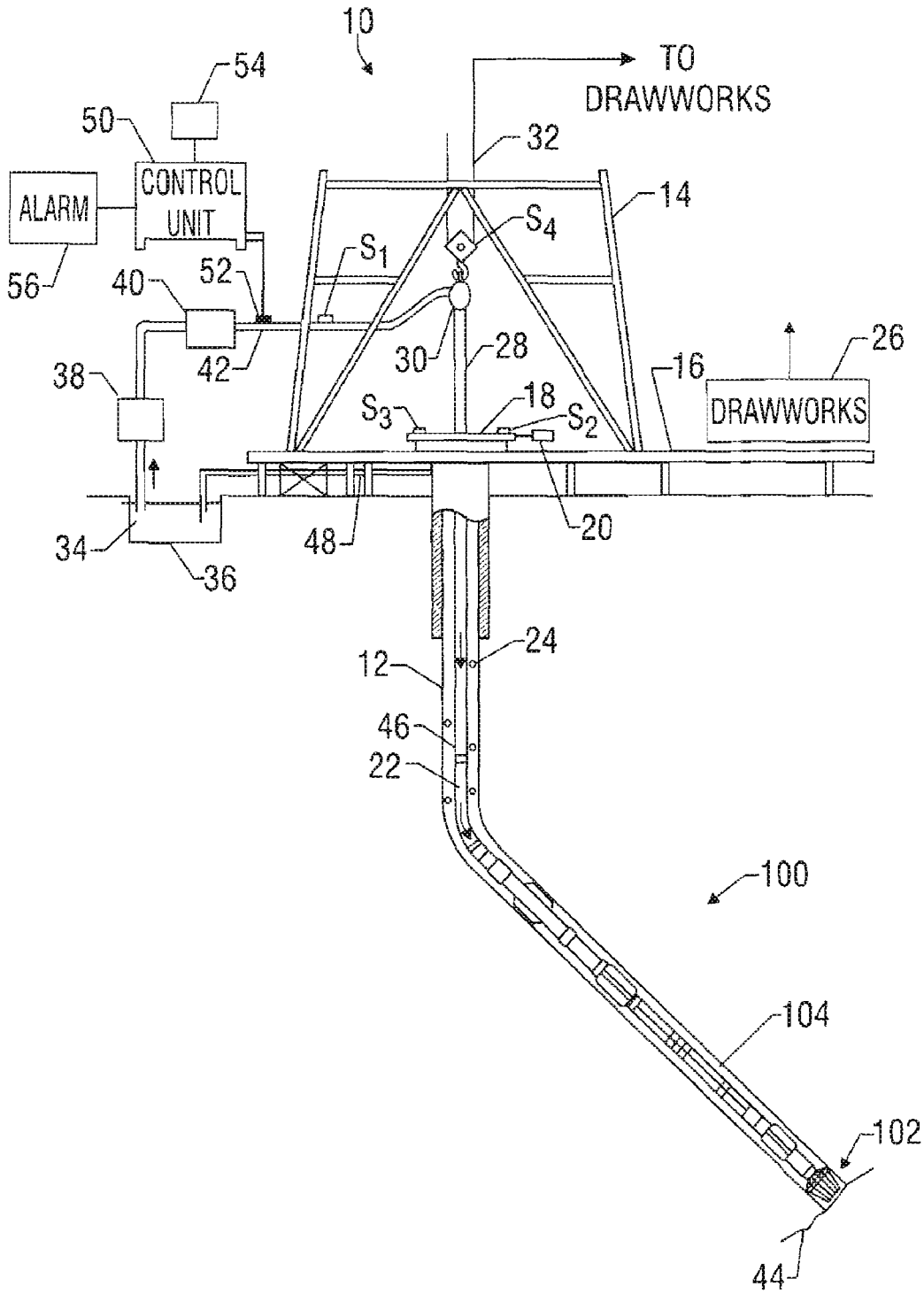
FIG. 1 illustrates a drilling system made in accordance with one embodiment of the present invention.

The present invention relates to devices and methods for conveying power such as electrical power and/or data signals. While the present invention will be discussed in the context of a drilling assembly for forming subterranean wellbores, the present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

Referring initially to FIG. 1, there is shown an embodiment of a land-based drilling system utilizing a drilling assembly 100 made according to one embodiment of the present invention to drill wellbores. These concepts and the methods are equally applicable to offshore drilling systems or systems utilizing different types of rigs. The system 10 shown in FIG. 1 has a drilling assembly 100 conveyed in a borehole 12. The drilling system 10 includes a derrick 14 erected on a floor 16 that supports a rotary table 18 that is rotated by a prime mover such as an electric motor 20 at a desired rotational speed. The drill string 22 includes a jointed tubular string 24, which may be drill pipe or coiled tubing, extending downward from the rotary table 18 into the borehole 12. The drill bit 102, attached to the drill string end, disintegrates the geological formations when it is rotated to drill the borehole 12. The drill string 22 is coupled to a drawworks 26 via a kelly joint 28, swivel 30 and line 32 through a pulley (not shown). During the drilling operation the drawworks 26 is operated to control the weight on bit, which is an important parameter that affects the rate of penetration. The operation of the drawworks 26 is well known in the art and is thus not described in detail herein.

During drilling operations, a suitable drilling fluid 34 from a mud pit (source) 36 is circulated under pressure through the drill string 22 by a mud pump 38. The drilling fluid 34 passes from the mud pump 38 into the drill string 22 via a desurger 40, fluid line 42 and the kelly joint 38. The drilling fluid 34 is discharged at the borehole bottom 44 through an opening in the drill bit 102. The drilling fluid 34 circulates uphole through the annular space 46 between the drill string 22 and the borehole 12 and returns carrying drill cuttings to the mud pit 36 via a return line 48. A sensor $S_1$ preferably placed in the line 42 provides information about the fluid flow rate. A surface torque sensor $S_2$ and a sensor $S_3$ associated with the drill string 22 respectively provide information about the torque and the rotational speed of the drill string. Additionally, a sensor $S_4$ associated with line 32 is used to provide the hook load of the drill string 22.

In one mode of operation, only the mud motor 104 rotates the drill bit 102. In another mode of operation, the rotation of the drill pipe 22 is superimposed on the mud motor rotation. Mud motor usually provides greater rpm than the drill pipe rotation. The rate of penetration (ROP) of the drill bit 102 into the borehole 12 for a given formation and a drilling assembly largely depends upon the weight on bit and the drill bit rpm.

A surface controller 50 receives signals from the downhole sensors and devices via a sensor 52 placed in the fluid line 42 and signals from sensors $S_1$, $S_2$, $S_3$, hook load sensor $S_4$ and any other sensors used in the system and processes such signals according to programmed instructions provided to the surface controller 50. The surface controller 50 displays desired drilling parameters and other information on a display/monitor 54 and is utilized by an operator to control the drilling operations. The surface controller 50 contains a computer, memory for storing data, recorder for recording data and other peripherals. The surface controller 50 processes data according to programmed instructions and responds to user commands entered through a suitable device, such as a keyboard or a touch screen. The controller 50 is preferably adapted to activate alarms 56 when certain unsafe or undesirable operating conditions occur.

Figure 2:
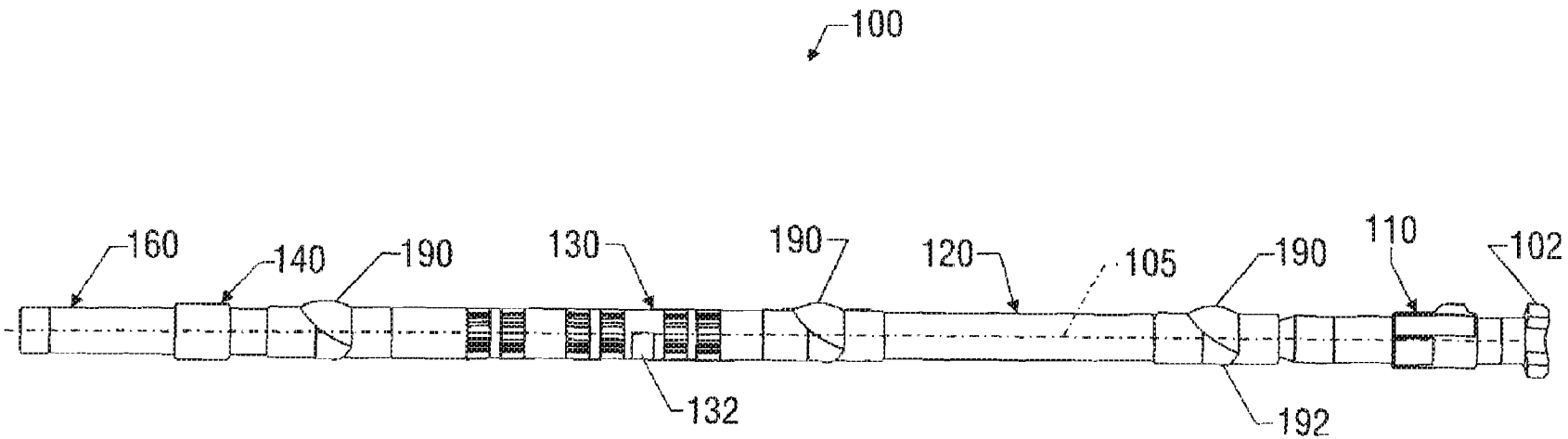
FIG. 2 illustrates an exemplary bottomhole assembly made in accordance with one embodiment of the present invention.

Referring now to FIG. 2, there is shown in greater detail an exemplary bottomhole assembly (BHA) 100 made in accordance with the present invention. The BHA 100 carries a drill bit 102 at its bottom or the downhole end for drilling the wellbore and is attached to a tubular string 24 (FIG. 1) at its uphole or top end. As will be described below, the BHA 100 can include tools that utilize electrical power, measure selected parameters of interest and provide data signals representative of the measurements, and/or operate in response to command signals.

In one embodiment, the BHA 100 includes a steering unit 110, a drilling motor 120, a sensor sub 130, a bidirectional communication and power module (BCPM) 140, stabilizers 190, and a formation evaluation (FE) sub 160. To enable power and/or data transfer among the individual tools making up the BHA 100, the BHA 100 includes a power and/or data transmission line 105. The power and/or data transmission line 105 can extend along the entire length of the BHA 100 up to and including the drill bit 102. Thus, for example, the line 105 can transfer electrical power from the BCPM 140 to the steering unit 110 and provide two-way data communication between the surface or BCPM 140 and sensors at the steering unit 110 and/or the drill bit 102.

Figure 3A:
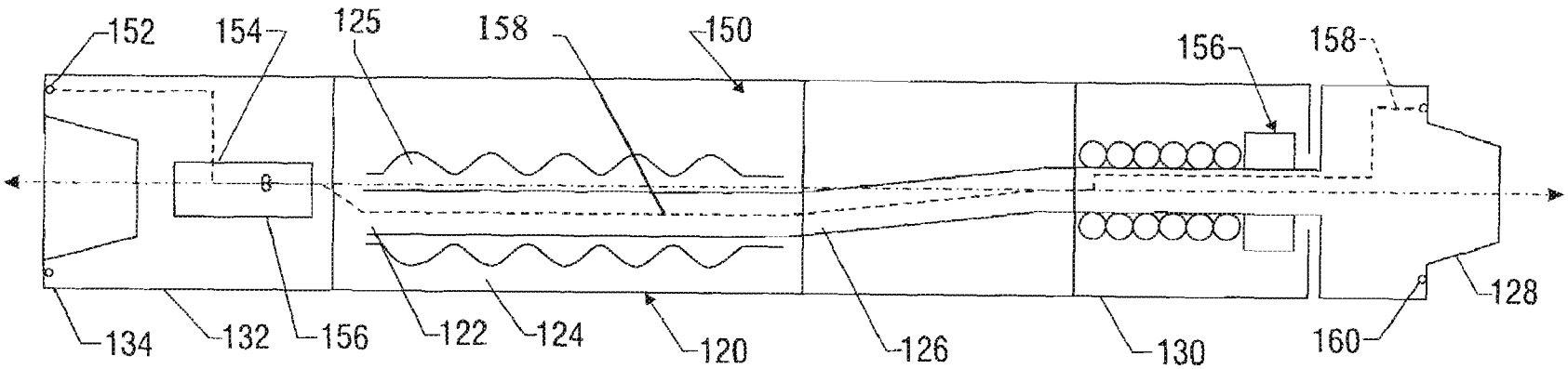
FIG. 3A illustrates an exemplary power/data transmission unit made in accordance with one embodiment of the present invention for conveying power and/or data through a rotor of a drilling motor.

Referring now to FIGS. 2 and 3A, there is shown a drilling motor 120 having a power/data transmission unit 150 operably coupled to the data/transmission line 105. In one embodiment, the drilling motor 120 is a positive displacement motor that includes a rotor 122 disposed in a stator 124 forming progressive cavities 125 there between. Fluid supplied under pressure to the motor 120 passes through the cavities 125 and rotates the rotor 122. The rotor 122 in turn is connected to the drill bit 102 via a flex shaft 126 connected to a drive shaft 128 having a suitable connection such as a having a threaded pin end. A bearing section 130 supports the drive shaft 128. At the other end, an upper sub 132 is coupled to the motor 120 and includes a threaded box end 134. The pin end 128 and box end 134 are merely one type of connection arrangement for connecting the drilling motor 120 to adjacent modules or subs. Other connection device can also be used. Additionally, while the pin end 128 is shown as the termination of the power/data transmission unit 150, it should be understood that in other embodiments, the termination may be positioned further downhole, e.g., at the steering unit 110 or drill bit 102.

The schematically illustrated exemplary power/data transmission unit includes one or more conductive elements or carriers for transmitting power and/or data across the motor 120 and for enabling two-way or bidirectional data transfer across the motor 120. In some embodiment, the data and power can be conveyed by conductive elements in the rotor or the stator. In other embodiments, transceivers can be positioned along the motor 120 to transmit the data and/or power. Exemplary arrangements are described below.

In embodiments, a power/data transmission unit 150 transfers power and/or data between the ends of the motor housing such as the box end 134 and the pin end 128 of the motor 120. In an exemplary arrangement, the power/data transmission unit 150 includes an electrical contact 152 at the box end 134 and an electrical contact 160 at the pin end 128. A non-rotating section is formed by a conductive element 154 that is coupled at one end to the box end contact 152 and coupled at the other end to a power/data transfer unit 156. A rotating section is formed by a conductive element 158 in the shaft 126 that is coupled at one end to the pin end contact 160 and coupled at the other end to the power/data transfer unit 156. The power/data transfer unit 156 is adapted to transfer power and/or data from the conductive element 154 in the non-rotating portion of the motor 120 to the conductive element 158 in the rotating flex shaft 126 and drive shaft 128. A suitable power/data transfer unit can include slip ring cartridges having a non-rotating conductive element that contacts a sliding conductive element (e.g., mating metal rings), inductive couplings, or other transfer devices. Thus, power such as electrical power and data signals are conveyed through the motor 120 via a conductive path formed by the box end electrical contact 152, the conductive element 154 in the stator 124, the power/data transfer unit 156, the conductive element 158 in the shaft 126, and the pin end electrical contact 160.

Figure 3B:
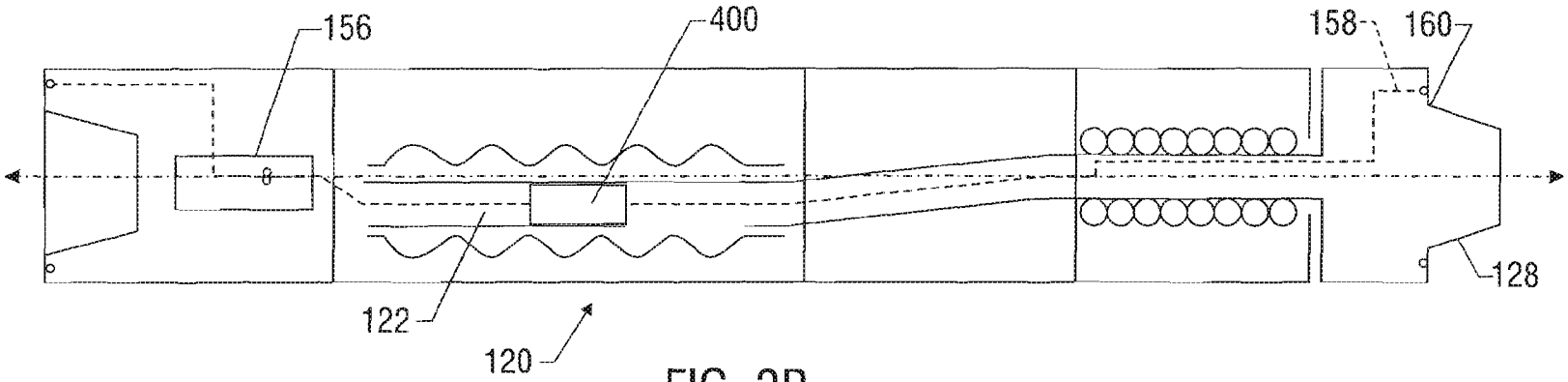
FIG. 3B illustrates an alternative embodiment to the FIG. 3A embodiment wherein an electronics package is positioned in a rotor of a drilling motor.

Referring now to FIG. 3B, there is shown another embodiment generally similar to that illustrated in FIG. 3A. However, in the FIG. 3B embodiment, an electronics package 400 is positioned in the rotor 122. The electronics package 400 is coupled to the conductive element 158, which runs between an electrical contact 160 at one end 128 of the motor 120 to the power/data transfer unit 156. The electronics package 400 can include sensors for measuring parameters such as vibration, rotational speed, stresses, a processor for processing or decimating data, digitizers, and PLC's. The electronics package can also include other known wellbore electronics such as electronics that drive or operate actuators for valves and other devices.

Figure 3C:
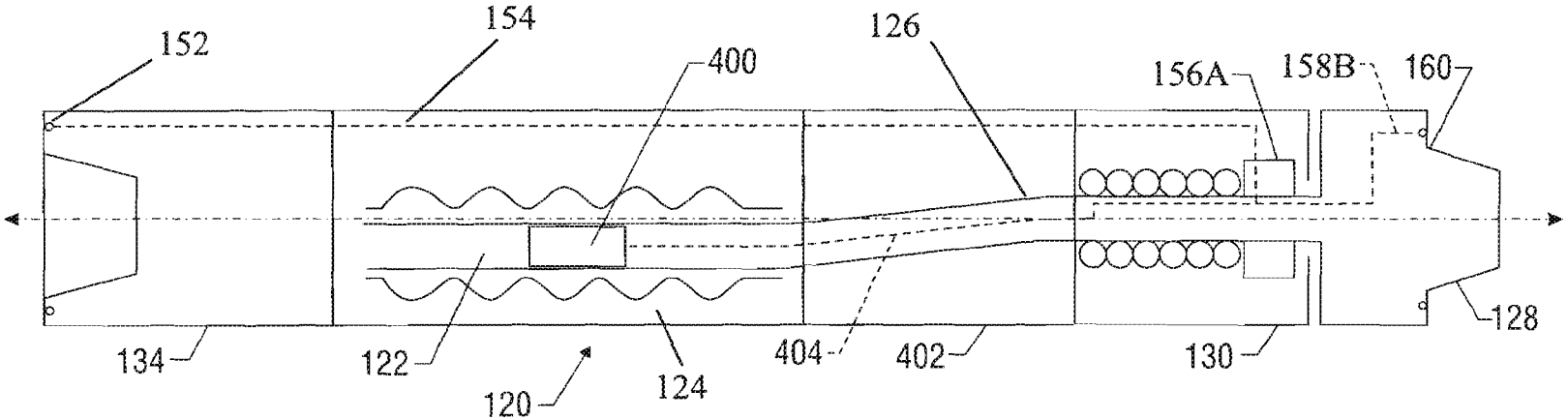
FIG. 3C illustrates an exemplary power/data transmission unit made in accordance with one embodiment of the present invention for conveying power and/or data through a stator of a drilling motor.

Referring now to FIG. 3C, there is shown another embodiment for transferring power/data across a motor 120. In the FIG. 3C embodiment, a conductive element 154 runs from a contact 152 at one end 134 of the motor 120 to the power/data transfer unit 156A. More specifically, the conductive element 154 runs through the housing of the sub 132, the stator 124, the housing 402 of the flex shaft 126, and the housing of the bearing section 130. Thus, the conductive element 154 runs through the non-rotating sections of the motor assembly 120. In contrast to the FIG. 3A embodiment, the power/data transfer unit 156A is positioned within the bearing section 130 rather than in the sub 132 uphole of the rotor 122. The conductive element 158B runs from the power/data transfer unit 156A to the contact 160. Optionally, an electronics package 400 can be positioned in the rotor 122 or the stator 124 and connected to the conductive element 158B and/or the power/data transfer unit 156A via a suitable conductor 404.

It should be understood that the embodiments illustrated in FIGS. 3A-3C are not exhaustive of the variations of the present invention. Rather, these discussed embodiments are intended as examples of how the teachings of the present invention can be applied.

In the above-described embodiment, the conductive elements 154 and 158 can be formed of one or more insulated wires or bundles or wires adapted to convey power and/or data. In embodiments, the wires can include metal conductors. In other embodiments, other carriers such as fiber optic cables may be used. The conductive element 154 can be run within a channel or conduit (not shown) in sub 132 and the stator 124. The conductive element 158 can be run within a bore (not shown) of the flex shaft 126 and drive shaft 128.

Figure 4:
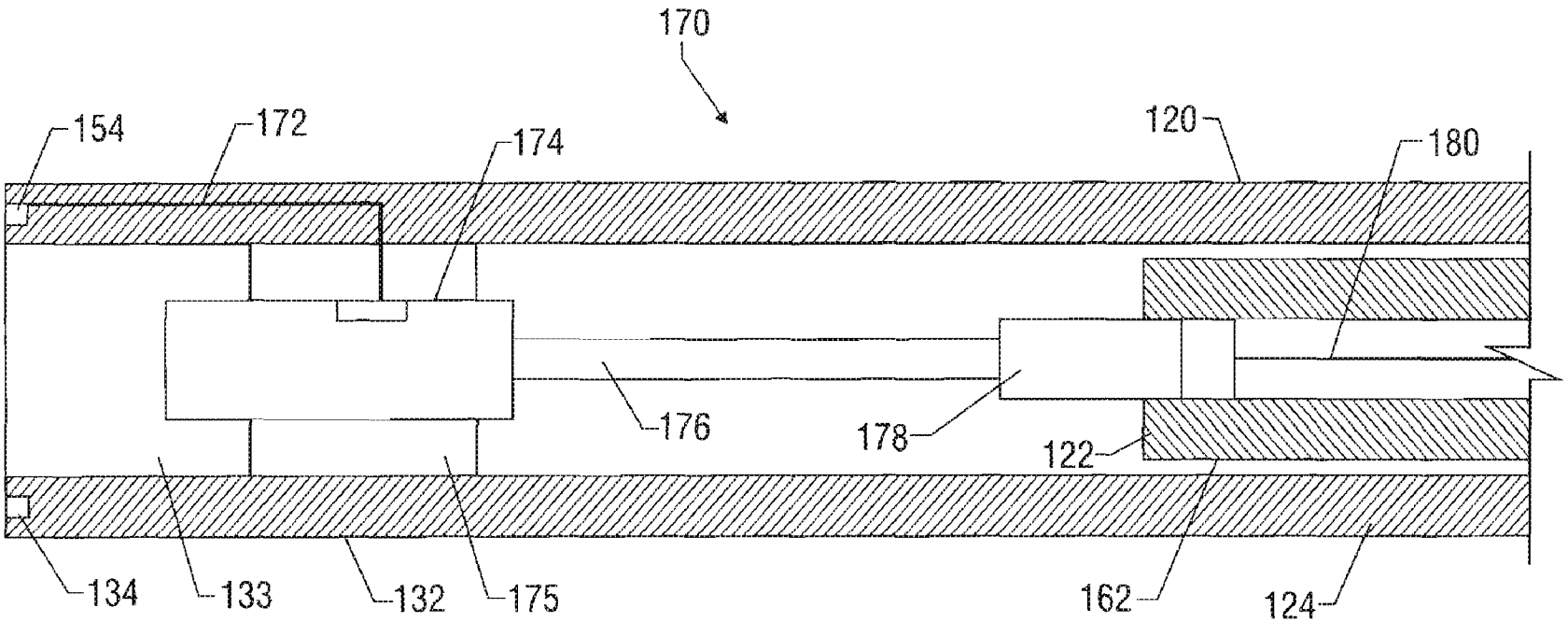
FIG. 4 illustrates an exemplary power/data transmission unit made in accordance with one embodiment of the present invention for conveying power and/or data through a rotor of a drilling motor.

Referring now to FIG. 4, there is shown an exemplary power/data transmission unit 170 made in accordance with the present invention that transfers power and/or data across the motor 120. In the FIG. 4 embodiment, power and/or data signals are transferred across the motor 120 using one or more conductive elements positioned in the rotor 122. Because of the relative rotational motion between the rotor 122 and the stator 124, the power/data transmission unit 170 can be considered as having a rotating section or power/signal line in the rotor 122 and a non-rotating section or power/data line in the stator 124 or adjacent sub or module. A power/data transfer unit 174 is used to transfer power and/or data between the rotating and non-rotating sections. Moreover, as is known, the rotor 122 rotates eccentrically in the stator 124 during operation. Thus, the power/data transmission unit 170 compensates for radial and axial movement of the rotor 122 in a manner described below.

As shown in FIG. 4, the non-rotating section of the power/data transmission unit 170 includes one or more conductive elements 172 positioned along a sub 132 (or stator housing or other adjacent module). The rotating section of the power/data transmission unit 170 is positioned partially inside or on top of the rotor 122 and includes the flexible member 176, a length compensation device 178, and a conductive element 180. Each of these devices include suitable conductors (e.g., metal conductors, fiber optic wires, etc.) to convey power and/or data signals. The power/data transfer unit 174, which is positioned within the sub 132 with a centralizer 175, transfer power/data between these rotating and non-rotating sections of the power/data transmission unit 170.

In one embodiment, in the non-rotating section, the conductive element 172 is coupled to the contact 154 at the box end 134 of the sub 132. The conductive element 172 is run in a channel (not shown) or other suitable conduit formed in the sub 132 and terminates at the power/data transfer unit 174. The rotating section of the power/data transmission unit 170 is rotatably coupled to the power/data transfer unit 174 by the flexible member 176. The length compensation unit 178 connects the flexible member 176 to the conductive element 180 to thereby form a conductive path for data/power through the rotor 122. During operation, the length compensation unit 178 expands and contracts as needed to accommodate the motion of the rotor 122. The conductive element 180, which is connected to the length compensation unit 178, terminates at the pin contact 160 (FIG. 3). The flexible shaft 176 and the length compensation unit 178 absorb or otherwise accommodate the changes in radial motion and length, respectively, of the shaft 122. The power/data transfer unit 174 transfers power and/or data to and from the rotating flexible shaft 176 in a manner described below.

Figure 5:
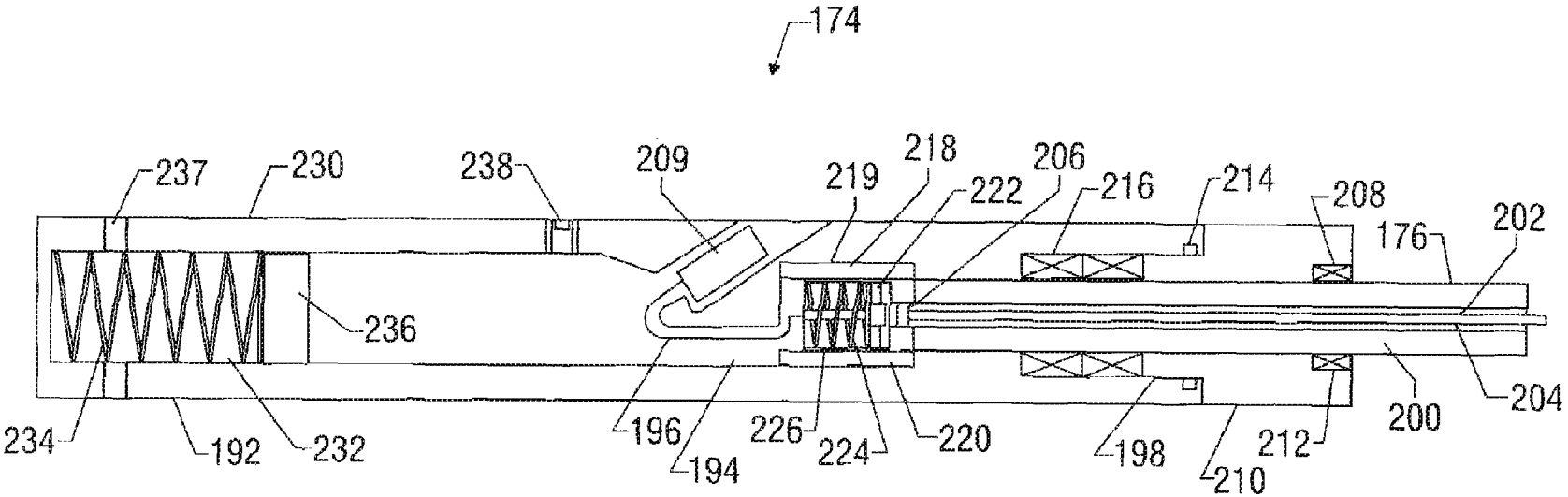
FIG. 5 illustrates a an exemplary power/data transfer unit made in accordance with one embodiment of the present invention.

Referring now to FIG. 5, there is shown an exemplary power/data transfer unit 174 made in accordance with one embodiment of the present invention. The power/data transfer unit 174 is adapted to transfer power and or data between the non-rotating conductor 174 and the rotating flexible member 176. In one embodiment, the flexible member 176 includes an outer flexible tubular member 200 and a conductive connector 202. An isolation sleeve 204 can be used to electrically insulate the conductive connector 202 from the outer tubular member 200. The conductive connector 202 has at one end a disk-like contact head 206 formed thereon for transferring power and/or data signals to/from the power/data transfer unit 174. A bearing assembly 208 stabilizes and controls rotation of the flexible member 176 within the power/data transfer unit 174. The bearing assembly includes a retainer body 210 for retaining bearings 212 and seals 214 for minimizing the entry of unwanted materials into the power/data transfer unit 174. Additionally, bearings 216 can be used to further stabilize the rotation of the flexible member 176.

Referring now to FIGS. 4 and 5, the power/data transfer unit 174 is fixed in the centralizer 175 that is positioned in a bore 133 of the sub 132. The centralizer 175 includes axial passages (not shown) that allow drilling fluid (not shown) to flow through the bore 133. The power/data transfer unit 174 includes a body 192 in which are formed channels 194 for receiving conductive elements 196 and an open end 198 adapted to receive the bearing assembly 208 and the flexible member 176. The conductive elements 196 are coupled at one end to an external connector 209 and at the other end to a contact assembly 218. The contact assembly 218 maintains continuity of power and data transfer between conductive elements 196 and the rotating conductive connector 202. An exemplary contact assembly 218 includes a cylinder 220 and a piston 222 biased within the cylinder 220 by a spring 224. The piston 222 is formed at least partially of a conductive material and is biased into physical engagement with the contact head 206 of the conductive connector 202. This physical engagement, however, allows the contact head 206 to rotate relative to the piston 222. Further, axial movement of the flexible member 176 during operation, either toward or from the piston 222, will not interrupt power/data transfer because the piston 222 can slide forward or backward as necessary to maintain the physical contact with the contact head 206.

Additionally, the power/data transfer unit 174 can include a pressure compensation unit 230 for controlling fluid pressure in the power/data transfer unit 174. In one embodiment, the interior cavities of the power/data transfer unit 174, such as the channel 194, are filled with a hydraulic fluid such as oil. An exemplary pressure compensation unit 230 for controlling the pressure of the fluid in the power/data transfer unit 174 includes a chamber 232 in which a spring 234 biases a piston head 236. In one arrangement, passages 237 are formed to allow the surrounding pressurized drilling fluid to apply hydrostatic pressure against the piston head 236. The spring force of the spring 234 is selected to maintain a desired amount of pressure on the hydraulic fluid. Plugs 238 are provided in the body 192 to allow filling and draining of fluid in the power/data transfer unit 174. Seals are also used as needed to maintain fluid integrity of the power/data transfer unit 174.

It should be appreciated that a drilling motor made in accordance with the present invention enables data and/or power transmission between equipment uphole of the motor and equipment downhole of the motor. For example, power and/or data signals can be transferred from the BCPM 140 to the steering unit 110. Also, sensors (not shown) in or near the drill bit 102 can transmit data to one or more processors (not shown) uphole of the motor 120. One exemplary advantage of the present invention is enabling the positioning of electronics and other equipment sensitive to vibration further uphole of the drill bit 102, which provides some measure of isolation from vibrations caused by the rotating drill bit 102. Another exemplary advantage is an increase in effectiveness of the drilling motor 120. That is, because the BCPM 140 can be positioned uphole of the motor 120, the length between the drill bit 102 and the motor 120 is reduced—which enhances the transmission of rotary power from the motor 120 to the drill bit 102.

Thus, as described above, power and/or data can be transferred between rotating and non-rotating members such as the flexible shaft 176 and power/data transfer unit 174 using a path formed by physical contact by two conductive elements. In other embodiments, an inductive coupling device can be used to transfer electric power and data signals between rotating and non-rotating members as more fully described below.

Figure 6:
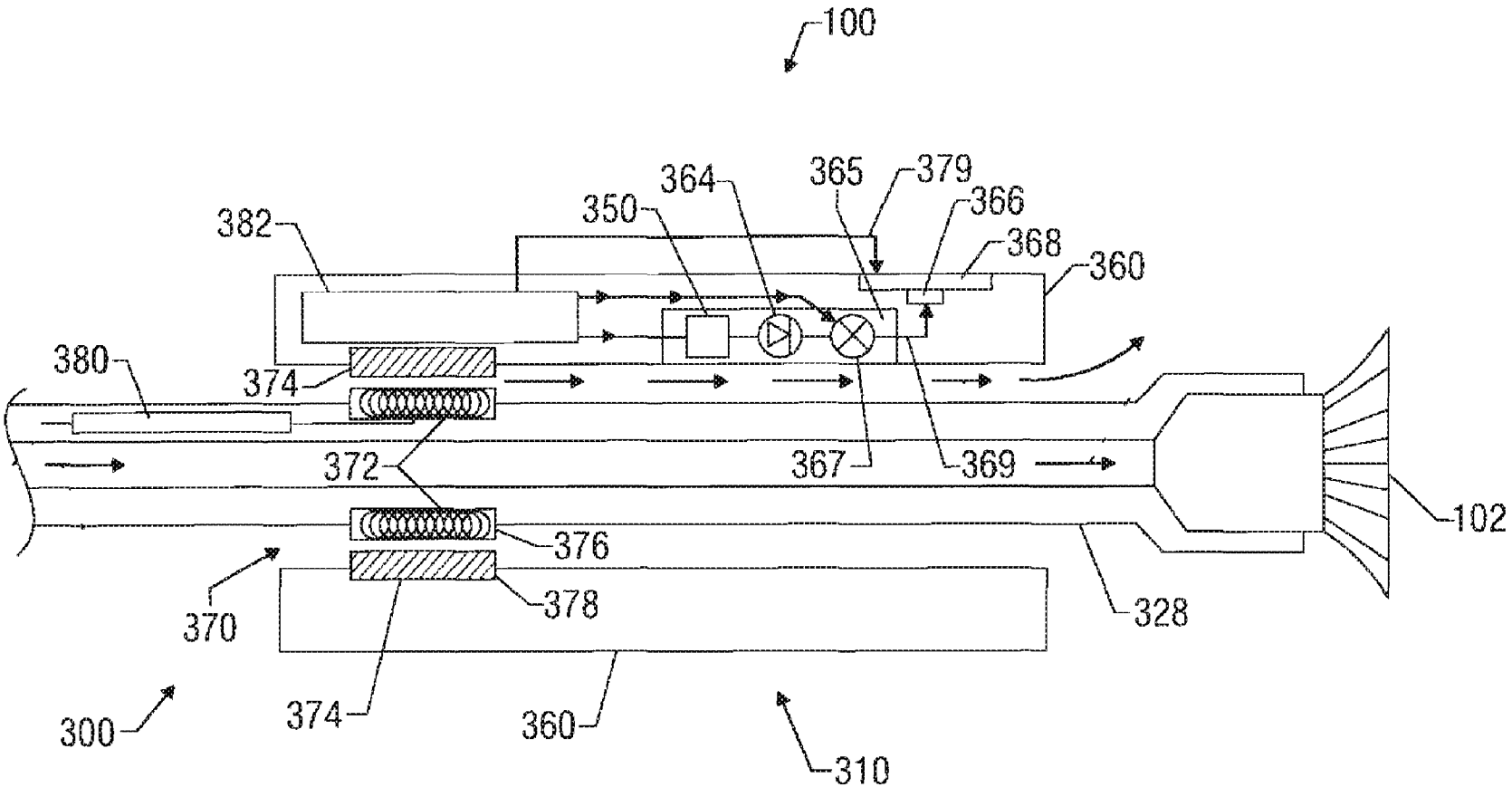
FIG. 6 shows a schematic functional block diagram relating to a power and data transfer device for transferring power and data between rotating and non-rotating sections of a bottomhole assembly.

Referring now to FIG. 6, there is shown a block functional diagram of a section of the BHA 100 that depicts the method for power and data transfer between the rotating and non-rotating sections of the BHA 100. In FIG. 6, a steering unit 310 is shown disposed on a rotating shaft 328 coupled at one end to the rotor of the drilling motor (e.g., at pin end 128 of FIG. 3) and at the other end to the drill bit 102. The steering unit 310 includes a non-rotating sleeve or member 360 and receives electrical power generated by the BCPM 140 and/or the surface via methods and devices previously described.

In one embodiment, electric power and data are transferred between a rotating drill shaft 328 and the non-rotating sleeve 360 via an inductive coupling. An exemplary inductive power and data transfer device 370 is an inductive transformer, which includes a transmitter section 372 carried by the rotating member 328 and a receiver section 374 placed in the non-rotating sleeve 360 opposite from the transmitter 372. The transmitter 372 and receiver 374 respectively contain coils 376 and 378. Power to the coils 376 is supplied by the primary electrical control circuit 380. The primary electronics 380 conditions the power supplied by the BCPM 140 or other source and supplies it to the coils 376. These coils 376,378 induce current into the receiver section 374, which delivers AC voltage as the output. The secondary control circuit or the secondary electronics 382 in the non-rotating member 360 converts the AC voltage from the receiver 372 to DC voltage. The DC voltage is then utilized to operate various electronic components in the secondary electronics and any electrically-operated devices.

Still referring to FIG. 6, a motor 350 operated by the secondary electronics 382 drives a pump 364, which supplies a working fluid, such as oil, from a source 365 to a piston 366. The piston 366 moves its associated rib 368 radially outward from the non-rotating member 360 to exert force on the wellbore wall. The pump speed is controlled or modulated to control the force applied by the rib on the wellbore wall. Alternatively, a fluid flow control valve 367 in the hydraulic line 369 to the piston may be utilized to control the supply of fluid to the piston and thereby the force applied by the rib 368. The secondary electronics 362 controls the operation of the valve 367. A plurality of spaced apart ribs (usually three) are carried by the non-rotating member 360, each rib being independently operated by a common or separate secondary electronics.

It should be understood that there may be a limited amount of rotation of the non-rotating member 360 relative to the wellbore wall. As noted earlier, in some modes of operation, drill string rotation is superimposed on the rotation of the drilling motor. These types of rotation can cause the surrounding non-rotating member (or sleeve) 360 to slowly rotate.

The secondary electronics 382 receives signals from sensors 379 carried by the non-rotating member 360. At least one of the sensors 379 provides measurements indicative of the force applied by the rib 368. Each rib has a corresponding sensor. The secondary electronics 382 conditions the sensor signals and may compute values of the corresponding parameters and supplies signals indicative of such parameters to the receiver section 374, which transfers such signals to the transmitter 372. A separate transmitter and receiver may be utilized for transferring data between rotating and non-rotating sections. Frequency modulating techniques, known in the art, may be utilized to transfer signals between the transmitter and receiver or vice versa. The signals from the primary electronics may include command signals for controlling the operation of the devices in the non-rotating sleeve. Suitable power transfer devices are discussed in U.S. Pat. No. 6,427,783, which is commonly assigned and which is hereby incorporated by reference for all purposes. Also, drilling systems are discussed in U.S. Pat. No. 6,513,606, which is commonly assigned and which is hereby incorporated by reference for all purposes.

It should be appreciated that the above-described arrangements and methods for transferring data and/or power can enhance flexibility in overall design of the BHA 100. With the benefits of the present invention, the relative positioning of such equipment in the BHA 100 is not necessarily limited by considerations relating to providing electrical and data connections to that equipment. Exemplary BHA equipment that can be connected to power and/or data transmission line 105 are discussed in greater detail below.

Referring now to FIG. 2, the bidirectional data communication and power module ("BCPM") 140 uphole of the drilling motor 120 and the steering unit 110 provides power to the steering unit 110 and two-way data communication between the BHA 100 and surface devices. In one embodiment, the BCPM generates power using a mud-driven alternator (not shown) and the data signals are generated by a mud pulser (not shown). The mud-driven power generation units (mud pursers) are known in the art thus not described in greater detail.

In one embodiment, the sensor sub 130 can includes sensors for measuring near-bit direction (e.g., BHA azimuth and inclination, BHA coordinates, etc.), dual rotary azimuthal gamma ray, bore and annular pressure (flow-on & flow-off), temperature, vibration/dynamics, multiple propagation resistivity, and sensors and tools for making rotary directional surveys. The sensor sub 130 can include one or more processors 132 that provide central processor capability and data memory.

The formation evaluation sub 160 can includes sensors for determining parameters of interest relating to the formation, borehole, geophysical characteristics, borehole fluids and boundary conditions. These sensor include formation evaluation sensors (e.g., resistivity, dielectric constant, water saturation, porosity, density and permeability), sensors for measuring borehole parameters (e.g., borehole size, and borehole roughness), sensors for measuring geophysical parameters (e.g., acoustic velocity and acoustic travel time), sensors for measuring borehole fluid parameters (e.g., viscosity, density, clarity, rheology, pH level, and gas, oil and water contents), and boundary condition sensors, sensors for measuring physical and chemical properties of the borehole fluid.

The subs 130 and 160 can include one or memory modules and a battery pack module to store and provide back-up electric power may be placed at any suitable location in the BHA 100.

Additional modules and sensors can be provided depending upon the specific drilling requirements. Such exemplary sensors can include an rpm sensor, a weight on bit sensor, sensors for measuring mud motor parameters (e.g., mud motor stator temperature, differential pressure across a mud motor, and fluid flow rate through a mud motor), and sensors for measuring vibration, whirl, radial displacement, stick-slip, torque, shock, vibration, strain, stress, bending moment, bit bounce, axial thrust, friction and radial thrust. The near bit inclination devices may include three (3) axis accelerometers, gyroscopic devices and signal processing circuitry as generally known in the art. These sensors can be positioned in the subs 130 and 160, distributed along the drill pipe, in the drill bit and along the BHA 100. Further, while subs 130 and 160 are described as separate modules, in certain embodiments, the sensors above described can be consolidated into a single sub or separated into three or more subs.

Also, the stabilizer 190 has one or more stabilizing elements 192 and is disposed along the BHA 100 to provide lateral stability to the BHA 100.

In some embodiments, the equipment described above is constructed as modules. For example, the BHA 100 can include a BCPM module 140, a sensor module 130, a formation evaluation or FE module 160, a drilling motor module 120, a stabilizer module 150, and a steering unit module 110. Each of these modules can be interchangeable. For example, the BCPM 140 may be connected above the MWD module 130 or above the FE module 160. Similarly, the FE module 160 may be placed below the sensor module 130, if desired. Also, one or more of the modules can be omitted in certain configurations. Still further, additional modules not discussed above can be inserted with ease into the BHA 100. Each module includes appropriate electrical and data communication connectors at each of their respective ends so that electrical power and data can be transferred between adjacent modules via modular threaded connections. Thus, the transmission line or conductive path 105 formed by one or more conductive elements position in or along the above described modules and subs can be used to transfer power and/or data along the BHA. In addition to optimizing equipment safety and operation, modular construction can increase the ease of manufacturing, repairing of the BHA and interchangeability of modules in the field.

Referring now to FIGS. 1-6, in an exemplary manner of use, the BHA 100 is conveyed into the wellbore 12 from the rig 14. During drilling of the wellbore 12, the steering unit 110 can be used to steer the drill bit 102 in a selected direction. The electrical power to operate the motor 350 for the steering unit 110 is generated by the BCPM 140 and conveyed to the motor 350 via the conductive line 105, including the power/data transmission unit 170, in the drilling motor 120. Electrical power, of course, can also be conveyed via the conductive line 105 to the sensors, processors and other electrical devices in the BHA 100. Additionally, command signals, data signals, sensor measurements can also be transmitted bi-directionally across the conductive path 105. For example, command signals may be transmitted from the BCPM sent to align or orient the pads of the steering unit to urge the drill bit 102 in a selected direction.

The power/data transmission unit and power/data transfer unit can be employed in multiple configurations. For example, the power/data transmission unit and power/data transfer unit can transmit/transfer (i) only power, (ii) only data, or (iii) both data and power. Additionally, the power/data transmission unit and power/data transfer unit can include two or more carriers, each of which can be formed to carry only power, only data, or both power and data. The nomenclature "power/data transmission unit" and "power/data transfer unit" are used merely for convenience to refer to all such configurations and not any particular configuration.

Additionally, the terms "rotating" and "non-rotating" in context can either describe rotation relative to an adjacent body or relative to a formation. For example, while parts described as "non-rotating" such as the stator may in certain mode of operation rotate due to rotation of the drill string, the condition being described in the relative non-rotation with respect to the rotor. Moreover, in context, the term "non-rotating" may not necessarily describe an absolute condition. For instance, there may be a relatively small amount of rotation for the part described as non-rotating.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

I claim:

1. An apparatus for forming a wellbore in an earth formation, comprising:

a drill string having a drill bit at an end thereof;

a drilling motor connected to the drill bit, the drilling motor configured to rotate the drill bit when energized by a pressurized drilling fluid; and a conductor disposed in the drilling motor, the conductor including a first conductive element inside a bore of a rotating section of the drilling motor and configured to physically engage and rotate relative to a second conductive element inside a non-rotating section of the drilling motor, the conductor being configured to conduct one of power and data signals.

2. The apparatus according to claim 1 wherein the conductor is configured to transfer one of power and data signals between the rotating section and non-rotating section.

3. The apparatus according to claim 2 further comprising a cartridge having the first and the second conductive elements in physical contact, the cartridge being fixed inside the bore of the drilling motor.

4. The apparatus according to claim 1 wherein the non-rotating section is a stator.

5. The apparatus according to claim 1 wherein the rotating section is a rotor and the second conductive element is positioned in a bore of the rotor.

6. The apparatus according to claim 5 further comprising a steering unit positioned between the drilling motor and the drill bit, the steering unit being configured to steer the drill bit, the steering unit including electronics electrically coupled to the second conductive element positioned in the rotor.

7. The apparatus according to claim 6 further comprising an inductive coupling configured to electrically couple the steering unit electronics to the second conductive element positioned in the rotor.

8. The apparatus according to claim 6 further comprising a power unit positioned uphole of the drilling motor, the power unit being electrically coupled to the steering unit electronics with the conductor.

9. The apparatus according to claim 6 further comprising a tool coupled to the drill string uphole of the drilling motor being selected from one of (i) a sensor sub; and a (ii) formation evaluation tool.

10. The apparatus according to claim 6 wherein the drilling motor and the steering unit are modular, and further comprising: a modular sensor sub; a modular formation evaluation tool sub; a modular power module; and a modular communication module.

11. The apparatus according to claim 5 wherein one of the first and the second conductive elements is configured to absorb a motion of the rotor.

12. The apparatus according to claim 1 further comprising electronics operably coupled to the conductor, the electronics being positioned in one of (i) a rotor associated with the motor, (ii) a stator associated with the motor, (iii) the non-rotating section of the drilling motor, and (iv) the rotating section of the drilling motor.

13. The apparatus according to claim 12 wherein the electronics is selected from one of (i) a sensor configured to measure a parameter of interest, and (ii) electronics configured to drive an actuator.

14. A method for forming a wellbore in an earth formation, comprising:

drilling the wellbore with a drill string having a drill bit at an end thereof;

rotating the drill bit with a drilling motor; and positioning a conductor that includes a first conductive element in a rotating section of the drilling motor and physically engaging and rotating relative to a second conductive element in a non-rotating section of the drilling motor; and conducting one of power and data signals across the drilling motor with the conductor.

15. The method according to claim 14 further comprising transferring one of the power and data signals between the rotating section and non-rotating section with the conductor.

16. The method according to claim 15 wherein the conductor transfers one of power and data signals between the rotating section and non-rotating section using a cartridge having the first and the second conductive elements in physical contact.

17. The method according to claim 14 further comprising positioning the second conductive element in a stator of the drilling motor.

18. The method according to claim 14 further comprising positioning the first conductive element in a bore of a rotor of the drilling motor.

19. The method according to claim 18 further comprising positioning a steering unit between the drilling motor and the drill bit, the steering unit being adapted to steer the drill bit, the steering unit and including electronics electrically coupled to at least one conductive element.

20. The method according to claim 19 further comprising electrically coupling the steering unit electronics to the conductive element positioned in the rotor with an inductive coupling.

21. The method according to claim 14 further comprising:

operably coupling electronics to the conductor, and positioning the electronics in one of (i) a rotor associated with the drilling motor, (ii) a stator associated with the drilling motor, (iii) the non-rotating section of the drilling motor, and (iv) the rotating section of the drilling motor.

22. The method according to claim 21 wherein the electronics is selected from one of (i) a sensor adapted to measure a parameter of interest, and (ii) electronics adapted to drive an actuator.

* * * * *